United States Patent [19]

Schuster et al.

[11] Patent Number: 5,074,153

[45] Date of Patent: Dec. 24, 1991

[54] THREAD TENSIONING FORCE METER FOR TEXTURING UNIT FOR THE FALSE TWISTING OF SYNTHETIC THREADS

[75] Inventors: Friedrich Schuster, Hammelburg; Wilhelm Mang, Eschau-Hobbach; Serdar Gökpekin, Hammelburg, all of Fed. Rep. of Germany

[73] Assignee: FAG Kugelfischer Georg Schäfer, Fed. Rep. of Germany

[21] Appl. No.: 518,126

[22] Filed: May 3, 1990

[30] Foreign Application Priority Data

May 5, 1989 [DE] Fed. Rep. of Germany ..... 3914880

[51] Int. Cl.[5] ..... G01L 5/04

[52] U.S. Cl. ..... 73/862.47

[58] Field of Search ..... 73/862.45, 862.47, 862.48

[56] References Cited

U.S. PATENT DOCUMENTS

| | | | |
|---|---|---|---|
| 3,212,328 | 10/1965 | Coldren et al. | 73/862.45 |
| 3,495,454 | 2/1970 | Heimes | 73/862.48 |
| 4,759,226 | 7/1988 | Leurer | 73/862.48 |

*Primary Examiner*—Charles A. Ruehl

*Attorney, Agent, or Firm*—Ostrolenk, Faber, Gerb & Soffen

[57] ABSTRACT

Calibration of a thread tensioning force meter on a texturing unit for a false twist machine was previously performed differently depending upon the direction of withdrawal, that is forwardly or rearwardly, of the thread from the texturing unit. The thread passes the tensioning force meter by passing over a spring biased support abutment connected with a meter. In the invention, the outlet past the tensioning force meter includes a withdrawal point and slightly upstream of that point a calibration point, which points are separated by a thread eye through which the thread passes. The location of the calibration point is selected with respect to the withdrawal point and with respect to the position of the abutment engaged by the thread that regardless of whether the thread is withdrawn forwardly or rearwardly of the meter, the thread continuously contacts the calibration point. In one direction of withdrawal, the thread only contacts the calibration point. In the opposite direction of withdrawal, the thread first contacts the calibration point and then contacts the thread guide outlet, which holds a thread passing through the thread eye against the calibration point.

5 Claims, 2 Drawing Sheets

THREAD TENSIONING FORCE METER FOR TEXTURING UNIT FOR THE FALSE TWISTING OF SYNTHETIC THREADS

BACKGROUND OF THE INVENTION

The present invention relates to a texturing unit of a false twisting texturing machine and particularly to calibrating the tensioning force meter for the thread.

The course of the thread in false twisting texturing machines differs with respect to the entrance and departure in the direction toward the front of or toward the rear of the texturing machine. In one case, the thread exits and is pulled off in the machine direction. In the other case, the exiting thread is pulled off in the direction away the machine. All of these texturing machines or units can be equipped with a thread tensioning force meter (see German patent P 35 06 698). Every thread tensioning force meter must be calibrated for the thread tensioning force over the spring element in the meter over which the thread travels. These thread tensioning force meters must be provided with corresponding thread guides at the inlet and the outlet of the meter for the thread guidance. The calibration is effected at a minimum load (for instance 20 cN) (Centi-Newtons) and with predetermined maximum load (for instance 80 cN).

If the thread is now withdrawn in the machine direction, the calibration point lies at the rear lowermost point of contact of the thread guide. Upon removal of the thread from the meter in the forward direction, this calibration point lies at the front edge of the thread guide.

Therefore two different calibrations processes are necessary. As a result, two different thread tensioning force meters are also necessary. These differently calibrated thread tensioning force meters cannot be distinguished from each other by their external appearance so that confusion between them can very easily occur, in addition to the requirement for double stocking of meters.

Since calibration of a force tensioning meter mounted in a specific machine can only be carried out with great difficulty, the calibration must be carried out on the thread tensioning force meter before it is installed in a machine. However, very frequently the manner or direction in which the thread is pulled off in the particular machine is unknown in advance of use. This has the result that thread tensioning force meters have to be recalibrated by the individual customer. The consequences of this are incorrect measurements and therefore defective yarns or high expenses for sending a mechanic for the disassembly, recalibration and reinstallation of the meter.

SUMMARY OF THE INVENTION

It is the object of the present invention to so develop a thread tensioning force meter that only one calibration is necessary for thread removal from the meter in either the forward or rearward directions.

In a thread tensioning force meter of a texturing unit for a false twist machine, calibration should be the same regardless of the direction of withdrawal, that is forwardly or rearwardly, of the thread from the texturing unit. At the texturing unit, the thread passes the tensioning force meter by passing over a spring biased abutment in the unit. The outlet from the tensioning force meter includes a withdrawal point and, slightly upstream of the withdrawal point along the path of thread withdrawal, includes a calibration point, and these points are separated both laterally and along the path by a thread eye through which the exiting thread passes. The calibration point is selected with respect to the withdrawal point and with respect to the position of the spring biased abutment engaged by the thread that regardless of whether the thread is withdrawn forwardly or rearwardly of the meter, the thread continuously contacts the calibration point. In one direction of withdrawal, the thread contacts the abutment and only contacts the calibration point. In the opposite direction of withdrawal, the thread contacts the abutment, then contacts the calibration point and thereafter contacts the thread guide outlet, which holds a thread passing through the thread eye against the calibration point.

By locating the calibration point within the thread guide in front or upstream of the point of withdrawal, the thread must contact this point, regardless of the direction in which it is withdrawn. This creates the possibility that only one calibration process, namely that for 20 cN and 80 cN, is necessary for removal in the forward direction as well as for removal in the rearward direction. Different thread tensioning force meters calibrated for the opposite withdrawal directions are thus no longer required. As a result, confusion in selection of the thread tensioning force meters is also eliminated.

Other objects and features of the invention are explained below with reference to the drawings.

DESCRIPTION OF THE PREFERRED EMBODIMENT

Figure 1:
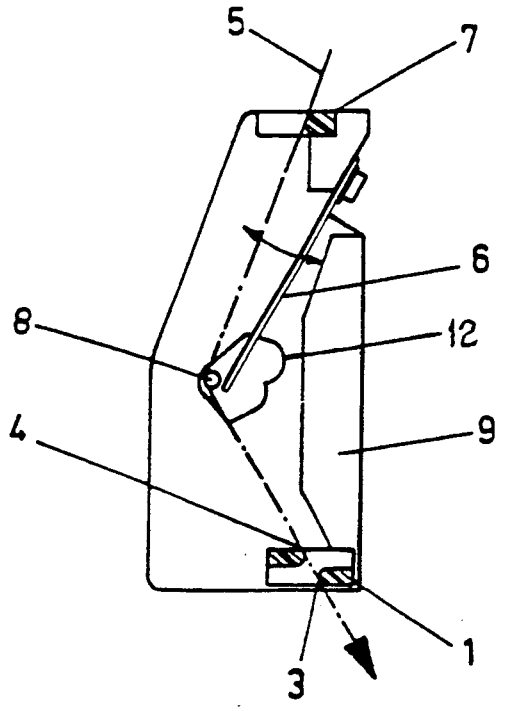
FIG. 1 shows a new arrangement of a thread guide within a thread tensioning force meter.

FIG. 1 shows a thread tensioning force meter of the invention in the opened housing 9 for the meter. The thread 5 is guided over the upper, entrance thread guide surface 7, which is supported on the housing, to the abutment which is in the form of a diabolo 8 and is fastened on the spring element 6, which is supported on the housing, at the opposite end of the spring element from the diabolo. From the diabolo, the thread passes downward over the calibration point 4 at the side of an element of the thread guide 1, which is supported on the housing, and then past the withdrawal point at the side of an element on the thread guide 1. The calibration and withdrawal points are generally opposed to each other and spaced apart. The spring element 6 is moveable generally laterally with respect to the thread eye between points 3 and 4 in the direction indicated by the arrow under the tension force of the thread acting in opposition to the spring force. The spring element reacts to the force, increases its tension and operates a sensor 12 to which the element 6 is connected to cause an indication of the thread tensioning forces. Spring element 6 is shown as a cantilevered leaf spring, but a compression spring or other conventional biasing element may be substituted. The thread entrance guide surface 7 is so positioned laterally of the thread path with respect to the diabolo 8 that the thread always engages the surface 7 in all shifted positions of the spring element 6.

Figure 2:
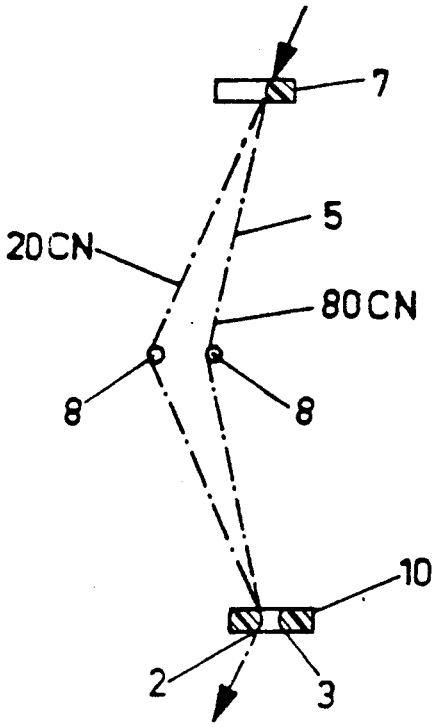
Fig. 2 PRIOR ART
FIGS. 2 and 3 show prior art arrangements for the differently directed withdrawn threads.
Figure 3:
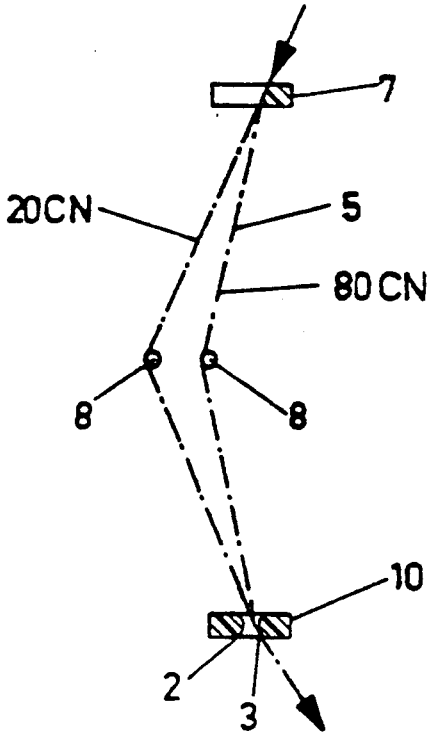
Fig. 3 PRIOR ART

FIGS. 2 and 3 show the prior art arrangement according to the previous calibration. FIG. 2 shows thread withdrawal in the forward direction over the withdrawal point 2 of the thread guide 10. The calibration is effected via the thread 5 at 20 cN and 80 cN. FIG. 3 shows the thread withdrawal process when the thread is withdrawn toward the rear.

Figure 4:
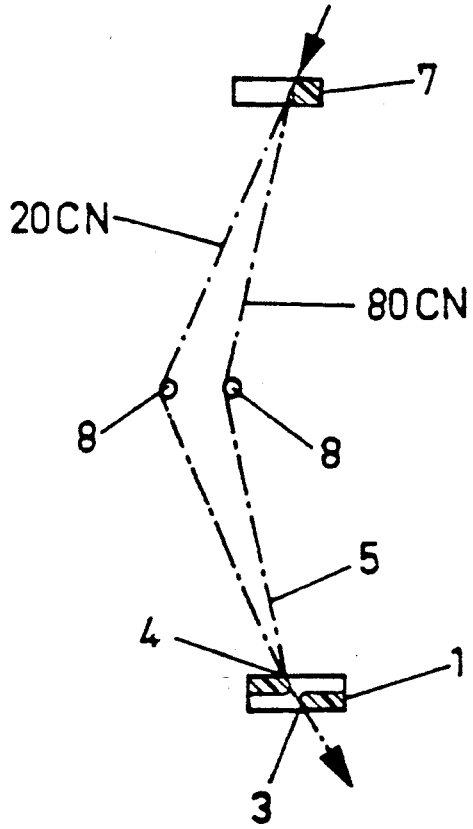
FIGS. 4 and 5 show the calibration arrangements in accordance with the invention with the calibration point in front of the point of withdrawal.
Figure 5:
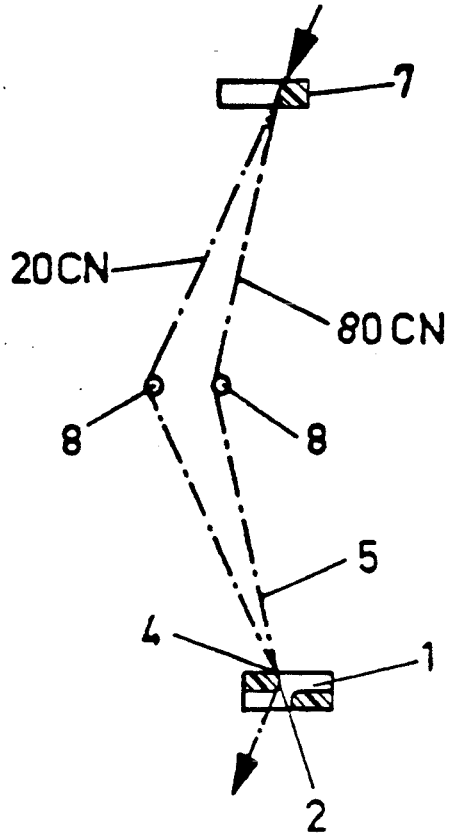

FIGS. 4 and 5 show the new calibration for rearward and forward withdrawal. In the meter, the abutment diabolo 8 is to that lateral side of the thread guide 1 that is beyond the calibration point 4, and the thread passes around the outside of the diabolo. This directs the thread past the calibration point 4 to enable the thread to continuously engage the point 4 regardless of the direction of thread withdrawal. In FIG. 4, upon rearward withdrawal, the thread 5 is guided over the calibration point 4 to the withdrawal point 3 of the thread guide 1. In FIG. 5, it can be noted that also upon the withdrawal of the thread in the forward direction, the thread first contacts the calibration point 4 and then passes to the withdrawal point 2 of the thread guide 1 which is shown on the same element of the thread guide as the calibration point 4 and is spaced away from the calibration point 4. The construction and course of movement of the calibration at 20 cN and 80 cN is effected in the manner described under FIGS. 2 and 3. The calibration point 4 is polished to a high gloss and is of low friction against the thread rubbing past it.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. Thread tension force meter for use with a texturing unit for false twist of synthetic threads, comprising:

a spring biased shiftable thread support which is shiftable generally laterally with respect to the path of the thread through the meter, and a spring operable in opposition to the shiftable support for countering the force applied to the support, first means defining and supporting a thread entrance point upstream of the thread support in the path of the thread through the meter and second means defining and supporting a thread withdrawal point downstream of the thread support in the path of the thread through the meter; the thread entrance and withdrawal points being so positioned that when a thread passes between those points and over the thread support, and when tension is applied to the thread, the thread causes the thread support to move against the bias of the spring, for producing a measurable tension;

just upstream of and before the thread withdrawal point in the path of the thread to the thread withdrawal point, third means defining and supporting a calibration point for being engaged by the thread and over which the thread passes, and the calibration point being located in a lateral direction with respect to the thread support and with respect to the path of the thread through the meter, such that through the whole path of spring biased motion of the thread support, the thread support is sufficiently to the lateral side of the calibration point that the thread constantly contacts the calibration point.

2. The meter of claim 1, wherein the second and third means are placed so that the calibration point and the withdrawal point are spaced apart and those points cooperate to define a thread guide eye through which the thread leaves the meter, and with the thread withdrawal point further downstream in the path of the thread movement than the calibration point, the calibration point and the thread withdrawal points being respectively so located laterally of the thread that upon thread withdrawal in one direction that thread wraps the calibration point, and upon thread withdrawal in the opposite direction the thread contacts the calibration point and also contacts the withdrawal point, the withdrawal point being so positioned that the thread contacts the calibration point no matter which lateral direction the thread is withdrawn as it is drawn past the withdrawal point.

3. The apparatus of claim 2, wherein the thread support is laterally to one side of a line between the thread entrance and withdrawal points, the calibration point is laterally to the same one side of the thread guide eye and the withdrawal point is to the opposite lateral side of the thread guide eye.

4. The apparatus of claim 3, wherein the first means comprises a surface over which the thread moves as it moves toward the thread support, and the thread entrance point is positioned with respect to the thread support so that regardless of how the thread support shifts under thread tension, the thread continuously contacts the thread entrance point.

5. The apparatus of claim 1, wherein the calibration point where the thread contacts it is polished so as to be low in friction against the thread.

* * * * *